US006068450A

United States Patent [19]

Parikh et al.

[11] Patent Number: 6,068,450

[45] Date of Patent: May 30, 2000

[54] DIAPHRAGM PUMP INCLUDING IMPROVED DRIVE MECHANISM AND PUMP HEAD

[75] Inventors: Manor M. Parikh, Roselle Park, N.J.; John A. Soper, Kent, United Kingdom; Ronald M. Bradbury, New South Wales, Australia

[73] Assignee: United States Filter Corporation, Palm Desert, Calif.

[21] Appl. No.: 09/304,127

[22] Filed: May 3, 1999

Related U.S. Application Data

[62] Division of application No. 08/663,807, Jun. 14, 1996, Pat. No. 5,957,669.

[60] Provisional application No. 60/000,242, Jun. 15, 1995.

[51] Int. Cl.[7] ..... F04B 1/06

[52] U.S. Cl. ..... 417/221

[58] Field of Search ..... 417/218, 221

[56] References Cited

U.S. PATENT DOCUMENTS 3,073,418 1/1963 Beatley .

4,420,393 12/1983 Smith ..... 210/101

FOREIGN PATENT DOCUMENTS 802046 8/1936 France .

3222577 12/1983 Germany ..... 417/221

0029772 2/1987 Japan ..... 417/22

*Primary Examiner*—Charles G. Freay

*Attorney, Agent, or Firm*—Wolf, Greenfield & Sacks, P.C.

[57] ABSTRACT

A mechanical actuated diaphragm pump for pumping fluids. The pump includes a pump housing having a chamber, a flexible diaphragm forming at least a portion of one wall of the chamber, a reciprocally movable member for causing reciprocal movement of a portion of the diaphragm, a rotating shaft connected to the reciprocally movable member such that rotation of the shaft causes reciprocation of the reciprocally movable member and a motor having an output shaft for driving the rotating shaft. The reciprocally moving member and the motor may be attached by an Oldham coupling.

4 Claims, 11 Drawing Sheets

DIAPHRAGM PUMP INCLUDING IMPROVED DRIVE MECHANISM AND PUMP HEAD

This application is division of Ser. No. 08/663,807 filed Jun. 14, 1996 now U.S. Pat. No. 5,957,669, and provisional application Ser. No. 60/000,242 filed Jun. 15, 1995.

BACKGROUND OF THE INVENTION

1. Field of the Invention

The invention relates to diaphragm pumps.

2. Discussion of Prior Art

Diaphragm pumps are commonly utilized for pumping a variety of fluids, such as chemicals, solutions and slurries. A diaphragm pump typically includes a pump head having a pumping chamber. A diaphragm forms a flexible wall enclosing the pumping chamber. The pump head includes a fluid inlet and a fluid outlet which communicate with the pumping chamber and with respective suction and discharge valves. The suction and discharge valves communicate with respective suction and discharge pipes in a piping system to permit fluid to enter the pumping chamber from the suction pipe and leave the pumping chamber into the discharge pipe. Typically, the suction and discharge valves are in the form of cartridges which are threaded into the pump housing and into a threaded connection with the respective suction or discharge pipe.

The diaphragm is driven by a connecting rod which is supported for reciprocal linear movement and which is driven by a rotatable eccentric. The eccentric and a worm wheel are mounted on a common rotatable shaft. A worm gear engages the worm wheel and thus drives the shaft and eccentric. The worm gear is connected to and rotates in common with an input shaft. The input shaft extends out of the gear box housing and at the outer end has mounted thereon a set of differently sized pulleys. Also mounted outside the gear box housing is a motor having an output shaft. A set of pulleys is mounted on the motor output shaft for receiving a drive belt. The drive belt engages one of the pulleys on the motor output shaft and one of the pulleys on the input shaft, such that the motor drives the input shaft and worm gear. The position of the drive belt can be changed between different pulley steps in order to selectively change the rotational speed of the input shaft relative to the motor.

U.S. Pat. No. 5,154,589 discloses a diaphragm pump including valve cartridges supported on the pump head with threaded collars. The pump head is provided with internal threads terminating adjacent to internal shoulders at each of the inlet and outlet valve ports. The inlet and outlet valves each include a flange which is secured to the shoulder by a collar threadably received in the respective port.

SUMMARY OF THE INVENTION

The invention provides a diaphragm pump including a pump head body having a reduced height and reduced pumping cavity volume, suction and discharge valves removably mounted on the lower portion of the pump head body, pipe connections releasably connected to the respective suction and discharge valves, and means for releasably supporting the suction and discharge valves on the pump head body, and this can be accomplished without disassembly of the piping in place.

The invention further provides a diaphragm pump including a flexible seal which extends between the cross head and the diaphragm adapter to prevent fluid which might leak through the diaphragm from entering the gear box.

The invention also provides a diaphragm pump including a drive mechanism including, among other elements, a motor, a worm gear, and means for alternatively and selectively connecting the motor directly or indirectly to the worm gear. An additional advantage of the invention is that the motor is oriented vertically so as to provide a small footprint for the drive unit.

BRIEF DISCUSSION OF THE DRAWINGS

DETAILED DESCRIPTION OF A PREFERRED EMBODIMENT

Figure 4:
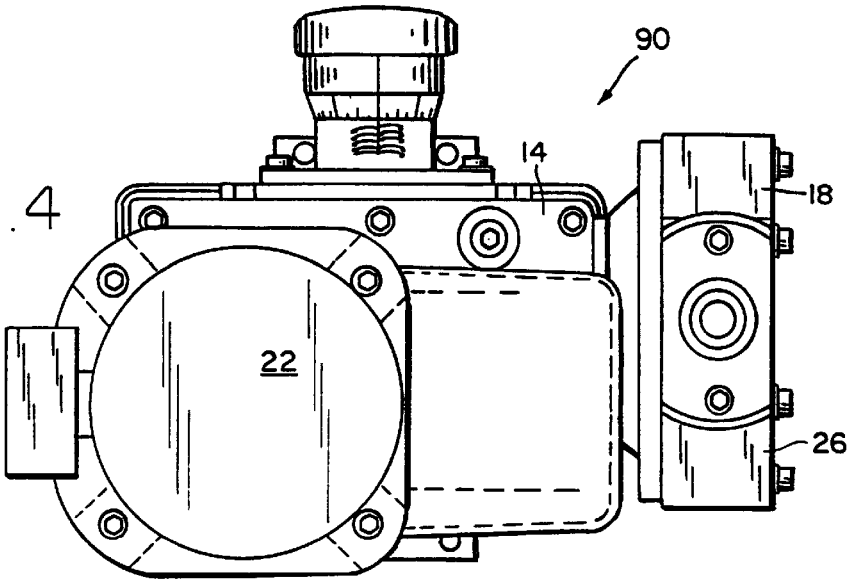
FIG. 4 is a top view taken generally along line 4—4 in FIG. 1.
Figure 1:
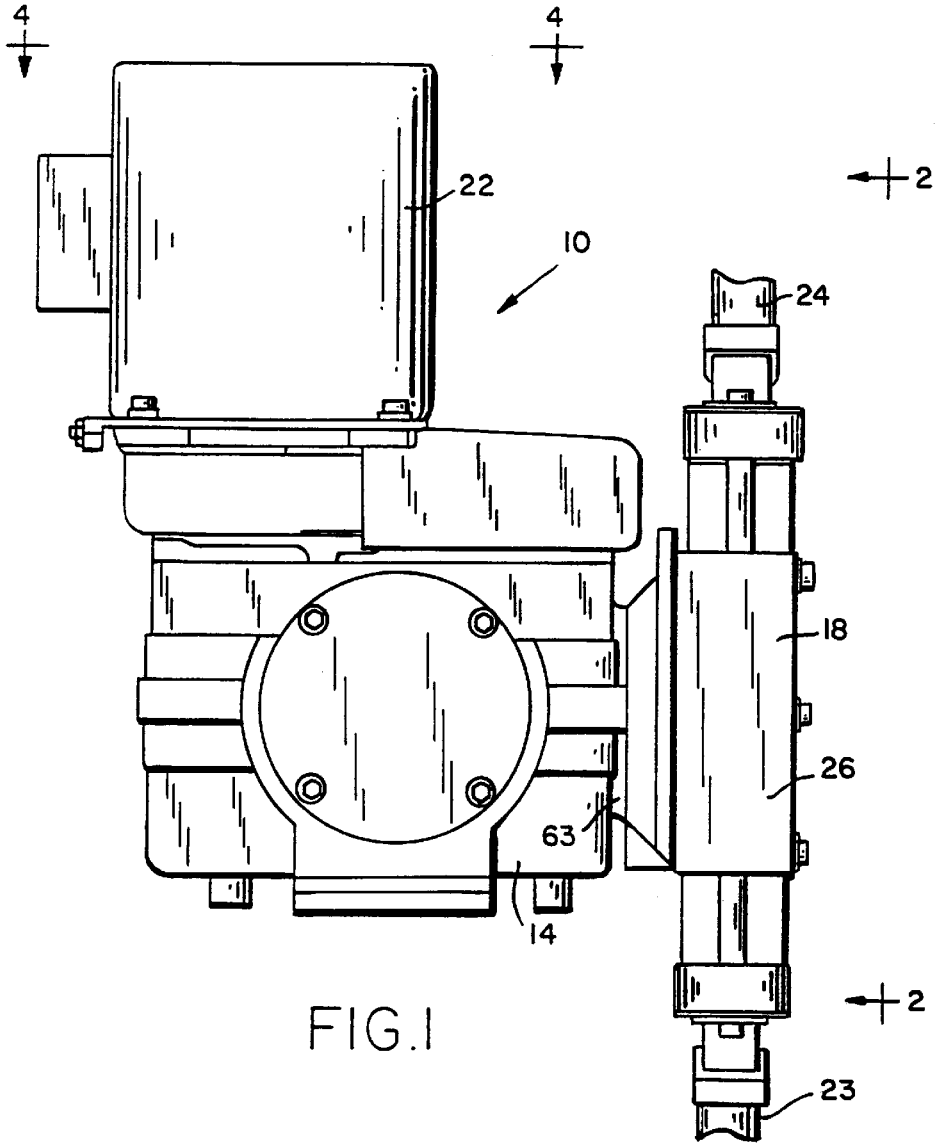
FIG. 1 is a side view of a diaphragm pump embodying the invention and arranged for indirect connection of the motor to the worm gear.
Figure 2:
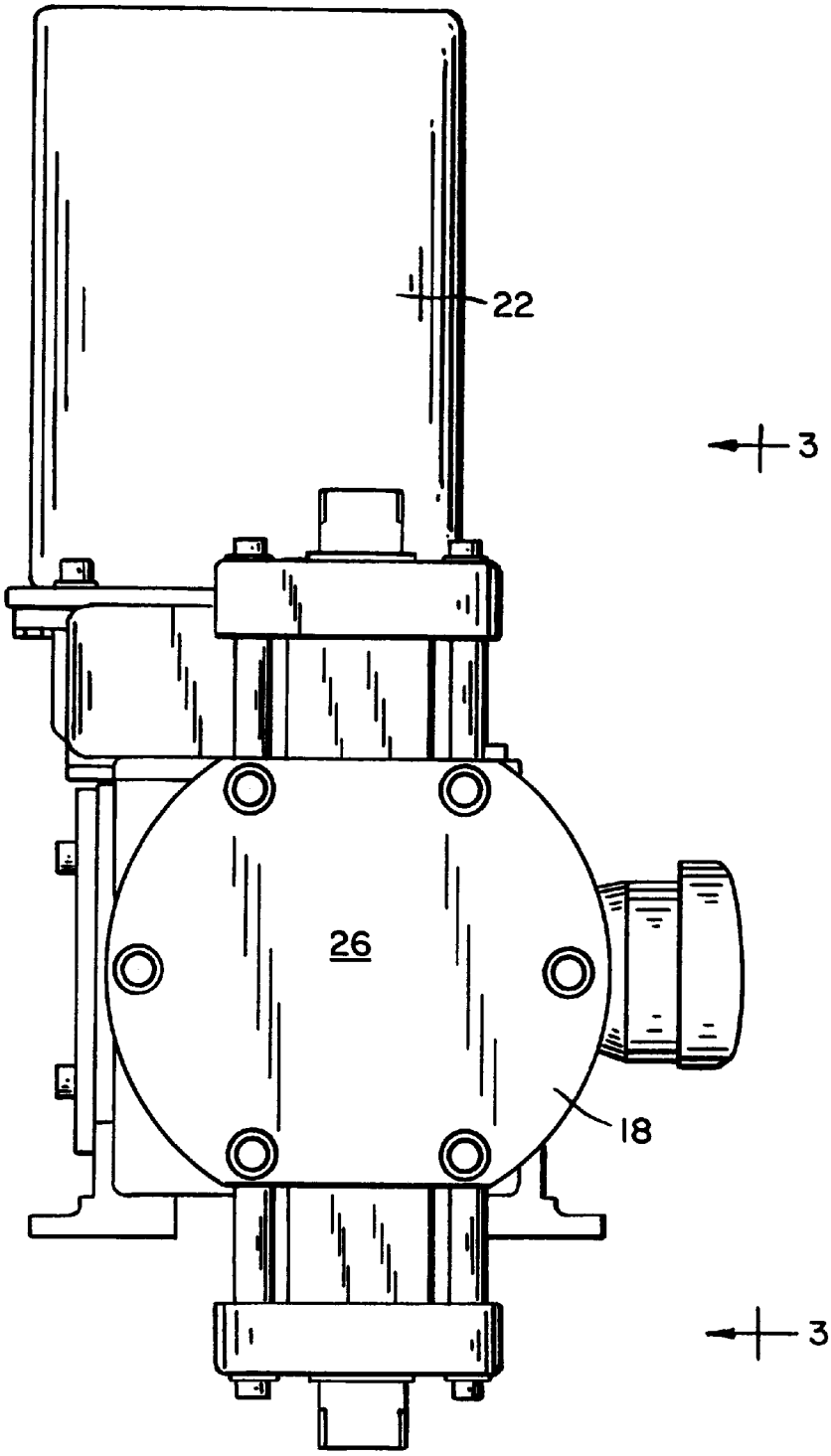
FIG. 2 is a front view taken generally along line 2—2 in FIG. 1.

Illustrated in FIG. 1 is a diaphragm pump 10 embodying various features of the invention. The diaphragm pump 10 includes a gear box 14 having mounted thereon a pump head 18 and an electric motor 22. The diaphragm pump 10 is releasably connected to a suction pipe 23 and to a discharge pipe 24 in a piping system. The suction and discharge pipes 23 and 24 include internal threads for connection to the diaphragm pump 10, as further described below.

Figure 12:
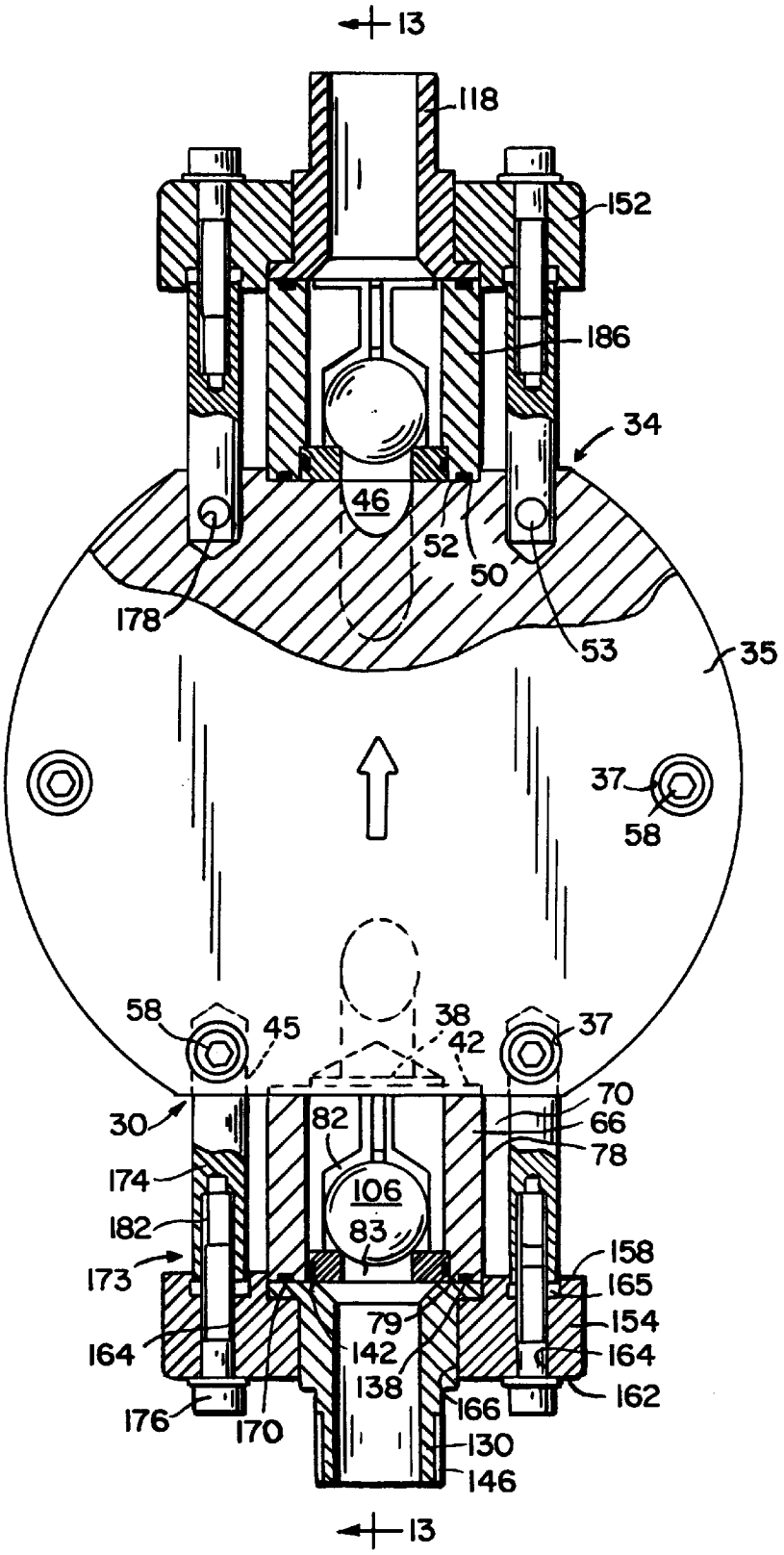
FIG. 12 is an enlarged partially sectional view of the pump head shown generally in FIG 2.
Figure 13:
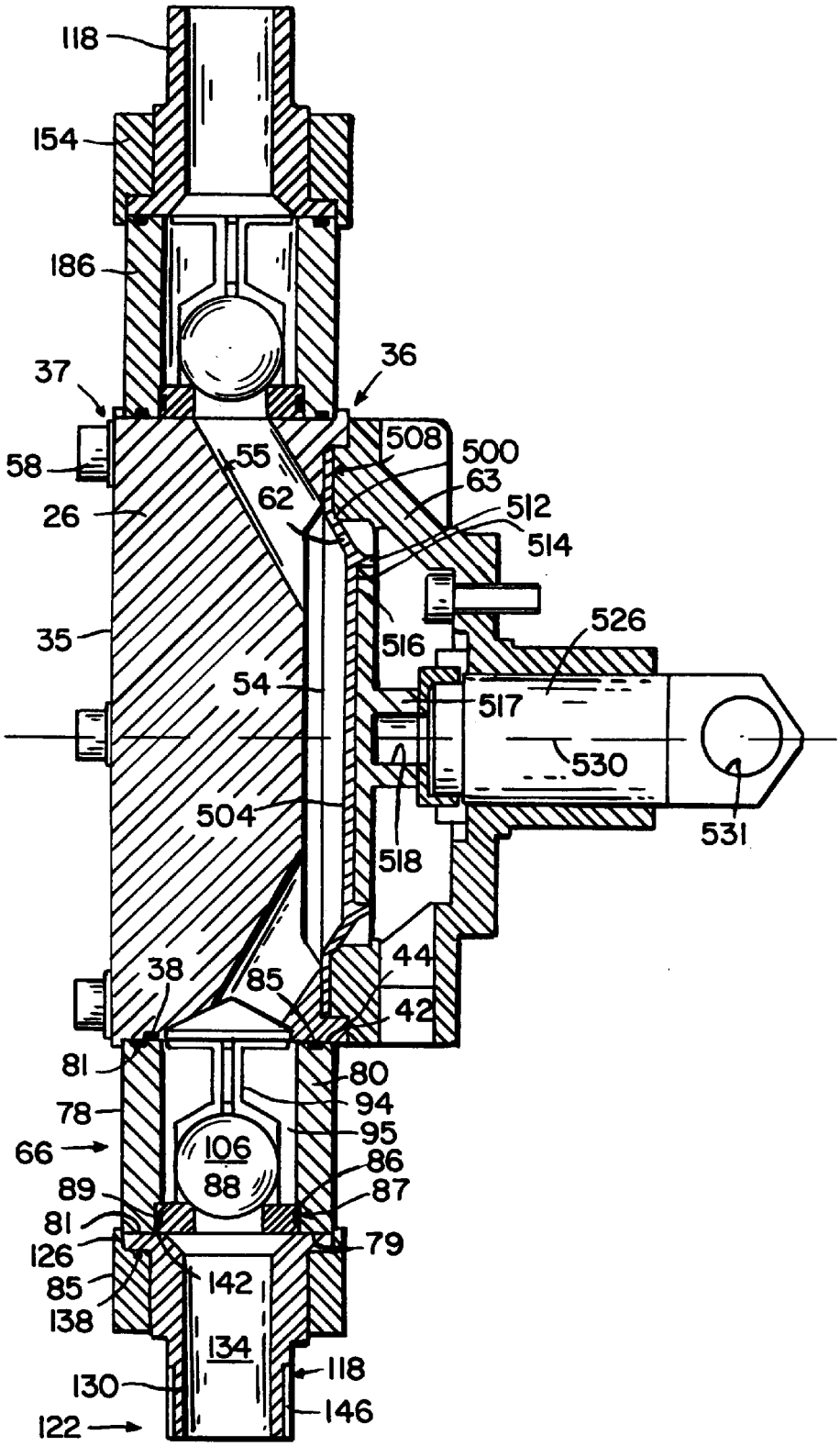
FIG. 13 is a cross sectional view taken generally along line 13—13 in FIG. 12.

The pump head 14 includes a pump head body 26. The pump head body 26 (FIG. 12) includes spaced lower and upper portions 30 and 34 and a front surface 35 extending between the lower and upper portions 30 and 34. The pump head body 26 also includes (FIG. 13) a rear portion 36 mates with a diaphragm 62 and a diaphragm adapter 63, as further described below. The pump head body 26 (FIG. 12) has six cap screw holes 37 extending between the front surface 35 and the rear portion 36. The screw holes 37 receive cap screws 58 which secure the pump head body 26 to the diaphragm adapter 63.

The lower portion 30 of the pump head body 26 includes (FIG. 13) an inlet port 38. The lower portion 30 also includes an annular, upwardly extending lower recess 42 which surrounds the inlet port 38. The lower recess 42 defines a downwardly facing annular shoulder 44. The lower portion 30 has (FIG. 12) two upwardly extending recesses 45 for receiving respective bolts, as further described below. The recesses 45 intersect with respective screw holes 37.

The upper portion 34 of the pump head body 26 includes an outlet port 46. The upper portion 34 also includes an annular, downwardly extending upper recess 50 which surrounds the outlet port 46. The upper recess 50 defines an upwardly facing annular shoulder 52. The upper portion 34 also has therein two downwardly extending recesses 53 for receiving bolts.

The pump head body 26 also includes (FIG. 13) an inner wall 55 which defines a pumping cavity 54. The pumping cavity 54 extends between and communicates with the inlet and outlet ports 38 and 46.

The diaphragm pump 10 further includes a suction valve 66 removably mounted on the lower portion 30 of the pump head body 26. The suction valve 66 has spaced upper and lower end portions 70 and 74. The suction valve 66 includes a cylinder or continuous outer wall 78 having opposite lower and upper end surfaces 79 and 80. The cylinder or outer wall 78 defines a valve passage 82 having a valve inlet 83 at the lower end portion 7 and a valve outlet 84 at the upper end portion 70. Each of the lower end surfaces 79 and 80 has therein a respective continuous groove 81. O-rings 85 are received in the grooves 81. The upper end portion 70 is received in the lower recess 42 of the pump head body 26, such that the upper end surface 80 and o-ring 85 abut the shoulder 44 and the valve outlet 84 communicates with the pump head inlet port 38.

A valve seat 86 is mounted in the valve passage 82 at the valve inlet 83. The valve seat 86 is an annular member including a continuous outer surface 87. The outer surface 87 has therein a continuous groove 88 which receives an O-ring 89 for sealing engagement with the outer wall 78. A valve member 106 is movably supported in the valve passage 82. In the illustrated embodiment, the valve member is a ball. The ball 106 is movable relative to the valve seat 86 for opening and closing the valve passage 82. A retainer 94 is mounted in the valve passage 82 and extends from the valve seat 86 to the valve outlet 84. The retainer 94 prevents the ball 106 from exiting the valve and maintains the ball 106 in alignment with the valve seat 86. In the illustrated embodiment, the retainer 94 comprises a set of spaced fins 95 which extend radically inwardly from the outer wall 78. The fins 95 cooperate with the valve seat 86 to define a space for movement of the ball 106. In the illustrated embodiment, the outer wall 78 and retainer 94 are molded as a single unit or piece. In the illustrated embodiment, the outer wall 78 and retainer 94 may be constructed of transparent material to permit observation of flow through the valve passage 82 and movement and seating of the ball 106. Although different materials may be used, in the illustrated embodiment the other wall 78 and retainer 94 are molded of transparent PVC.

The diaphragm pump 10 further includes a pipe connection 118 which is releasably connected to the suction pipe 23. The pipe connection 118 is independent of the suction valve 66. In the illustrated embodiment, the pipe connection 118 has spaced lower and upper ends 122 and 126. The pipe connection 118 includes a continuous wall 130 which defines a passage 134 extending between the lower and upper ends 122 and 126. The passage 134 thus communicates with the suction pipe 23 (FIG. 1) and with the valve passage 82 in the suction valve 66. The wall 130 includes an annular flange 138 at the upper end 126. The annular flange 138 defines an upwardly facing surface 142. The upper end 126 abuts the lower end portion 74 of the suction valve 66, such that the annular surface 142 sealingly engages the lower end surface 79 and O-ring 85. The wall 130 also includes a set of external threads 146 at the lower end 122. In other embodiments, the threads may be internal. The threads 146 matingly engage the threads on the suction pipe 23 (FIG. 1). In other embodiments, the suction pipe 23 may be connected to the pipe connection by means other than a threaded joint. For example, in other embodiments, the suction pipe 23 may be connected to the pipe connection by a butt joint, a welded joint, a flanged joint, or another suitable connection.

The diaphragm pump 10 also includes means 150 for releasably supporting the suction valve 66 on the pump head body 26. In the illustrated embodiment, the means 150 for releasably supporting the suction valve 66 includes a clamping block 154 which releasably engages the pipe connection 118. The clamping block 154 includes spaced upper and lower surfaces 158 and 162. The clamping block 154 has therein a pair of spaced screw holes 164 extending between the lower surface 162 and respective recesses 165 in the upper surface 158. The clamping block 154 includes a continuous inner wall 166 which extends between the upper and lower surfaces 158 and 162 and which defines an opening for receiving the pipe connection 118. The inner wall 162 includes an upwardly facing shoulder 170. The pipe connection 118 is received in the opening such that the inner wall 162 matingly engages the wall 130 of the pipe connection, and the shoulder 170 engages the flange 138 and thus urges the pipe connection 118 upwardly against the suction valve 66. The clamping block 154 thus urges the annular surface 142 of the pipe connection 118 into sealing engagement with the lower end surface 79 and the O-ring 81, and in turn urges the upper end surface 80 and O-ring 81 of the outer wall 78 of the suction valve 66 into sealing engagement with the shoulder 44 of the pump head body 26.

The means 150 for releasably supporting the suction valve 66 also includes means 173 for releasably supporting the clamping block 154 on the pump head body 26. In the illustrated embodiment, the means 173 for releasably supporting the clamping block 154 includes a pair of bolts 174 and a pair of cap screws 176 which cooperate to releasably support the clamping block 154. The upper end of each bolt 174 is received in a respective bolt recess 45 in the pump head body 26. The upper end of each bolt 174 has therein an aperture 178 which is transverse to the longitudinal axis of the bolt 174. One of the cap screws 58 extends through the cap screw hole 37 in the pump head body 26 and through the transverse aperture 178 and thus secures the upper end of the respective bolt 174 in the bolt recess 45. The lower end of each bolt 174 is received in a respective recess 164 in the upper surface 158 of the clamping block 154. The lower end of each bolt 174 has therein a longitudinally extending threaded recess 182. A cap screw 176 extends through a screw hole 164 in the clamping block 154 and is received in the longitudinal recess 182 to secure the clamping block 154 between the bolt 174 and the head of the cap screw 176. The set of bolts 174 and the head of the cap screw 176. The set of bolts 174 and cap screws 176 thus cooperate to releasably support the clamping block 154 in spaced relation to the lower portion 30 of the pump head body 26.

The diaphragm pump 10 further includes a discharge valve 186 which is removably mounted on the upper portion 34 of the pump head body 26 in an identical manner as the suction valve 66 is mounted on the lower portion 30. The discharge valve 186 communicates with the outlet port 46 and communicates with the discharge pipe 24 (FIG. 1) via a pipe connection 118. In other arrangements of the invention the valves 66 can include spring loaded balls.

The flexible diaphragm 62 (FIG. 13) cooperates with the pump head body 26 to close the pumping cavity 54. The diaphragm 62 includes a front portion 500 which is constructed of a suitable flexible material, such as TEFLON® and a rear portion which is constructed of HYPALON® with nylon reinforcement fibers. The Teflon is laminated to the rear portion. The front portion 500 includes a front wall 504 having a radially outwardly extending outer race 508. The outer race 508 is captured between the rear portion 36 of the pump head body 26 and the diaphragm adapter 63. The front portion 500 also includes a continuous projection or rim 512 extending from the front wall 504 in the direction away from the pumping cavity 54. The diaphragm 62 includes a rear portion 514 which extends from the front portion 500. The rear portion 514 is a disk shaped member having a continuous other edge 516. The rear portion 514 is secured to the front portion 500 by engagement of the outer edge 516 with the rim 512. The rear portion 514 also includes a projection 517 which extends perpendicular to the surface of the disk. The projection 517 has therein a threaded recess 518. In the illustrated embodiment, the rear portion 514 is constructed of metal.

Figure 14:
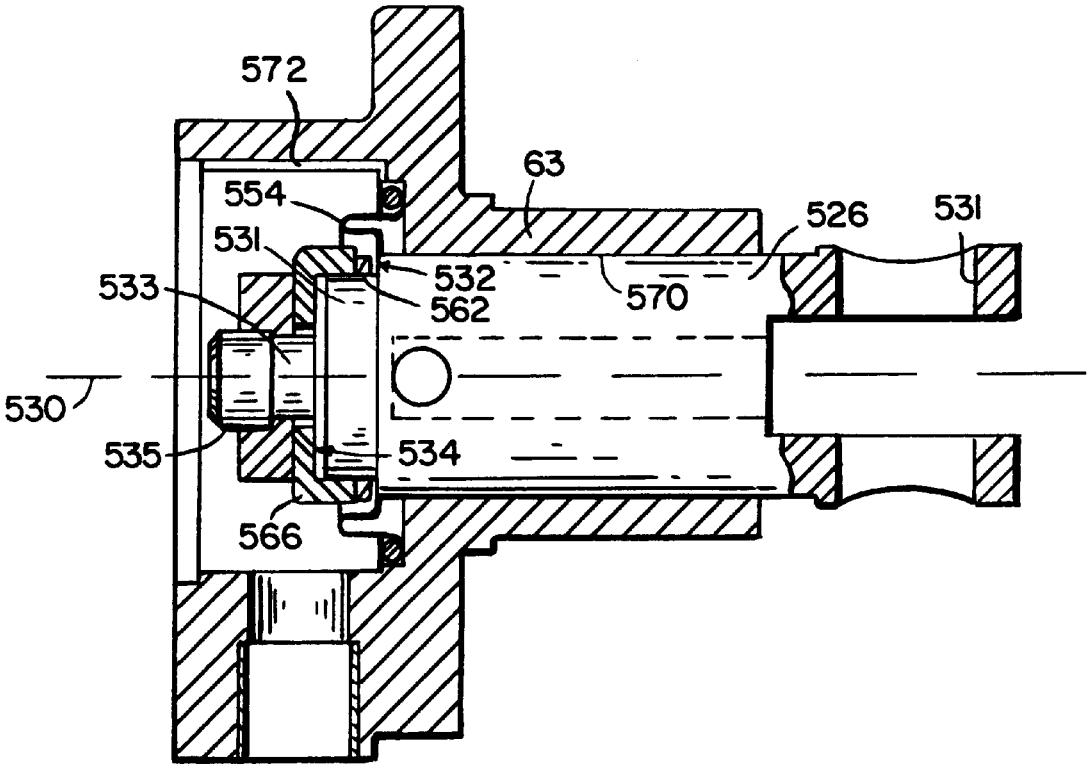
FIG. 14 is an enlarged view of a portion of FIG. 13.

The diaphragm pump 10 also includes a crosshead 526. The crosshead 526 (FIG. 14) is an elongated member having a longitudinal axis 530. The crosshead 526 is supported for reciprocal linear motion relative to the diaphragm 62 in the direction along the longitudinal axis 530. The inner end of the cross head 526 has therein an aperture 531 which is traverse to the longitudinal axis 530. The outer end of the cross head 526 includes a first reduced diameter portion 531 which terminates at a first shoulder 532. A second reduced diameter portion 533 extends from the first reduced diameter portion 531 and thus defines a second shoulder 534. The second reduced diameter portion 533 has external threads 535.

A flexible seal 554 extends between the outer end of the cross head 526 and the diaphragm adapter 63. In the event of diaphragm failure the flexible seal 554 prevents fluid which might leak through the diaphragm 62 from enter in the gear box 14. The flexible seal 554 is a continuous annular member having opposite outer and inner ends 558 and 562. The inner end 562 is securely engaged around the first reduced diameter portion 531 between the first shoulder 532 and a clamp 566. The clamp 566 is an annular member which surrounds the first reduced diameter portion 531, such that the second reduced diameter portion 533 extends therethrough. The clamp 566 is captured between the first shoulder 532 and a nut 568. The nut 568 has internal threads and is threaded onto the second reduced diameter portion 533.

The diaphragm adapter 63 includes a continuous inner wall 570. The inner wall 570 defines an inner bore 571 through which the cross head 526 extends. The inner wall also defines a continuous recess 572 about the inner bore 571. The outer end 562 of the flexible seal 554 is received in the recess 572.

The diaphragm pump 10 includes (FIG. 10) a drive mechanism 600 connected to the diaphragm 62. The drive mechanism 600 includes the cross head 526 connected to the diaphragm 62. A dowel pin 604 is received in the aperture 531 to connect the cross head 526 to a sleeve 608. The sleeve 608 is mounted on an elongated shaft 614 to form an Oldham coupling. The sleeve 608 has an internal cam surface 612. The shaft 614 has a longitudinal axis 616 and includes a cam surface 620. The internal cam surface 612 of the sleeve 608 mates with the cam surface 620 of the shaft 614. The shaft 614 is supported at its opposite ends by respective drive and tail bushings 624 and 628. The drive and tail bushings 624 and 628 are supported by respective tapered roller bearings 632 and 636 for rotation about the longitudinal axis 616. The shaft 614 thus is supported for rotation about the longitudinal six 616 by the bearings 624 and 628. The bearing 632 is supported by a bearing housing 640. The bearing 628 is supported by a bearing housing 644 and is secured against axial movement by a preload nut 648.

The diaphragm pump 10 includes a stroke control mechanism 652 for selectively adjusting the position of the cam surface 620 relative to the internal cam surface 612 of the sleeve 608 for controlling the length- of the stroke of the cross head 526. The stroke control mechanism 652 is of known construction and therefore will not be described in further detail.

A worm wheel 656 is fixed to the shaft 614 by screws 660 for rotation about the longitudinal axis 616. The worm wheel 656 includes a set of teeth 664.

A worm shaft 668 drives the worm wheel 656. The worm shaft 668 has (FIG. 11) a longitudinal axis 672 and is supported at its opposite ends by bearings 676 and 680 for rotation about the longitudinal axis 672. The worm shaft 668 has spiral worm teeth 684 which mesh with the worm wheel teeth 664 and thus drive the worm gear wheel 656. The worm shaft 668 also has first and second radially outwardly extending flanges 688 and 692 which define respective longitudinally facing shoulders 696 and 700. The worm shaft 668 at one end has an end surface 704 which is perpendicular to the longitudinal axis 672. The end surface 704 has therein a recess 708 which extends in the longitudinal direction for receiving a shaft, as further described below. The recess 708 includes a reduced diameter threaded portion 712 and an unthreaded portion 716 extending between the threaded portion 712 and the end surface 704. The unthreaded portion 716 includes a longitudinally extending key way 717.

The motor 22 includes (FIG. 6) an output shaft 718 which is supported for rotation about a longitudinal axis 720. The motor 22 also includes a motor housing 724. The motor housing 724 includes side walls and a rear wall which cooperate to form a rear housing portion 728. The motor housing 724 can be supported by interchangeable indirect drive and direct drive motor mounting adapter plates which can be mounted on the rear housing portion 728.

The direct drive motor mounting adapter (not shown) includes a first set of bolt holes which receive screws which are received in threaded recesses in the motor rear housing portion 728 for securing the motor 22 to the gear box in a first or direct drive position. The direct drive motor mounting adapter also includes a radially outwardly extending flange having therein bolt holes which receive bolts for securing the direct drive motor mounting adapter to a direct drive gear box cover (described below).

Figure 6:
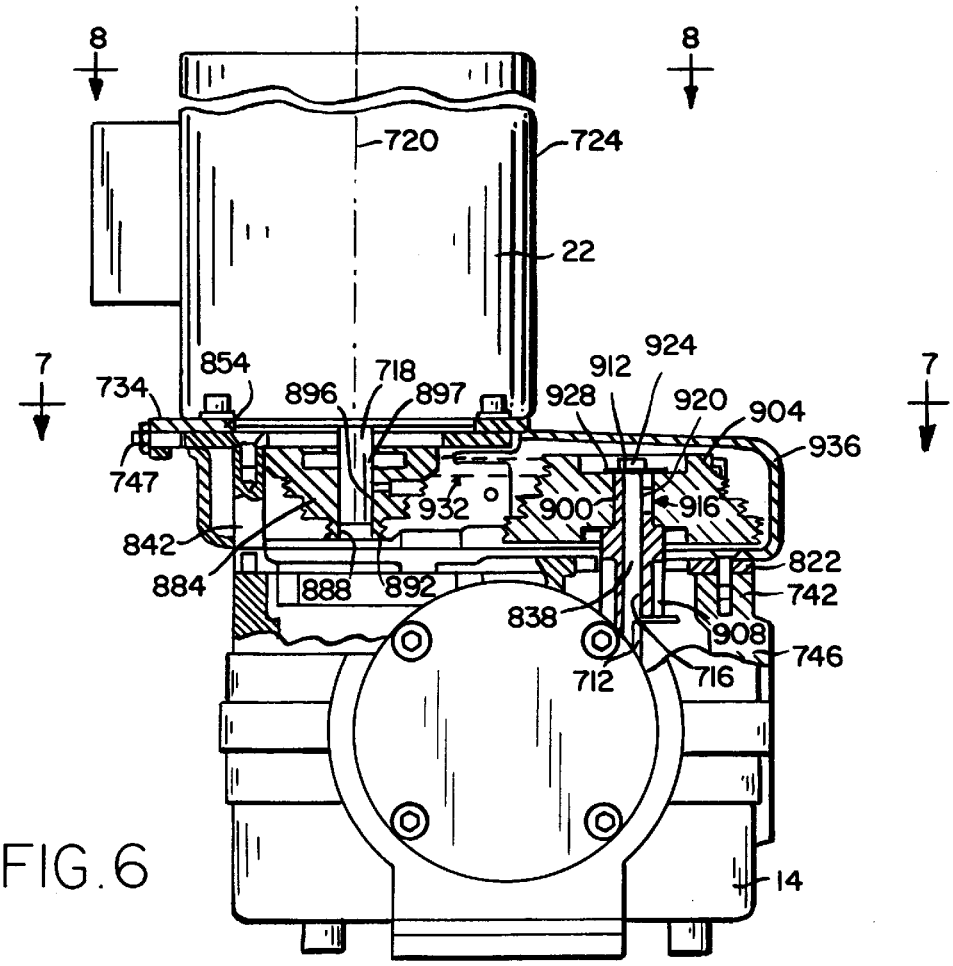
FIG. 6 is a partial broken away side view similar to FIG. 1 and with the diaphragm adapter and pump head omitted.
Figure 8:
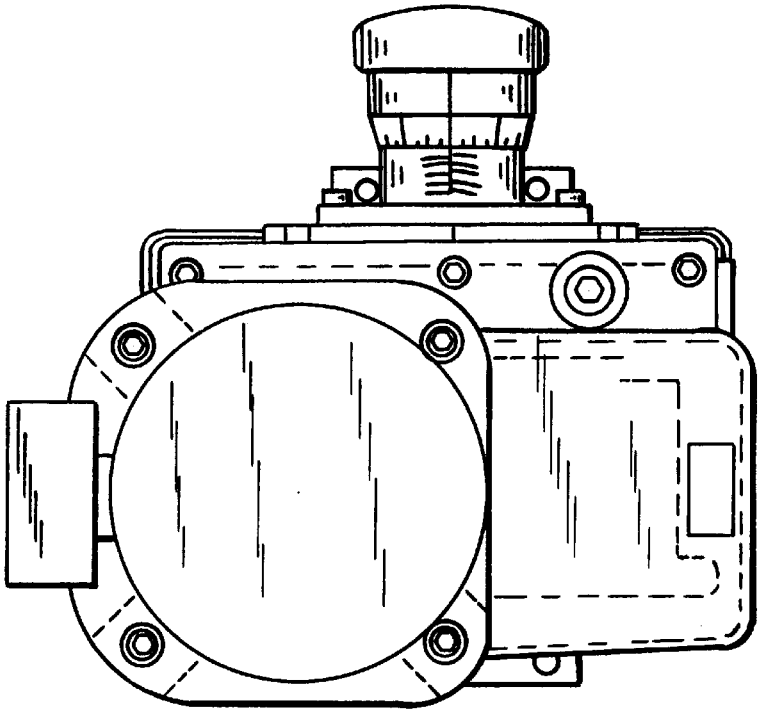
FIG. 8 is a top view taken generally along line 8—8 in FIG. 6.
Figure 9:
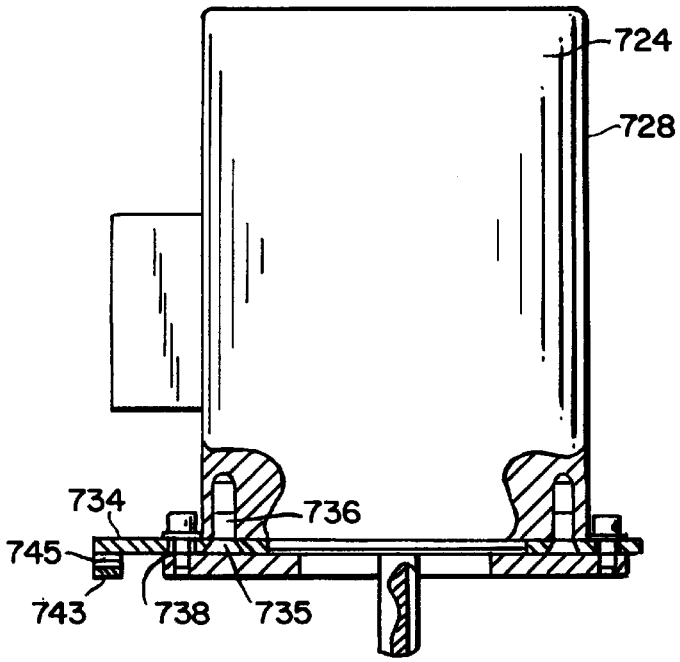
FIG. 9 is a broken away view of the motor shown generally in FIG. 6.

The indirect drive motor mounting adapter 734 is shown in FIG. 6. The indirect drive motor mounting adapter 734 includes a first set of bolt holes which receive screws which are received in threaded recesses in the motor rear housing portion 728 (FIG. 9). The indirect drive motor mounting adapter 734 also includes a radially outwardly extending flange having therein elongated bolt holes which receive bolts for securing the indirect drive motor mounting adapter 734 to a motor sliding plate. Referring to FIG. 9, the indirect drive motor mounting adapter 734 further includes a projection 743 having therein a threaded recess 745 which receives a set screw 747 (FIG. 6) for adjusting the tension of a drive belt (described below).

Figure 10:
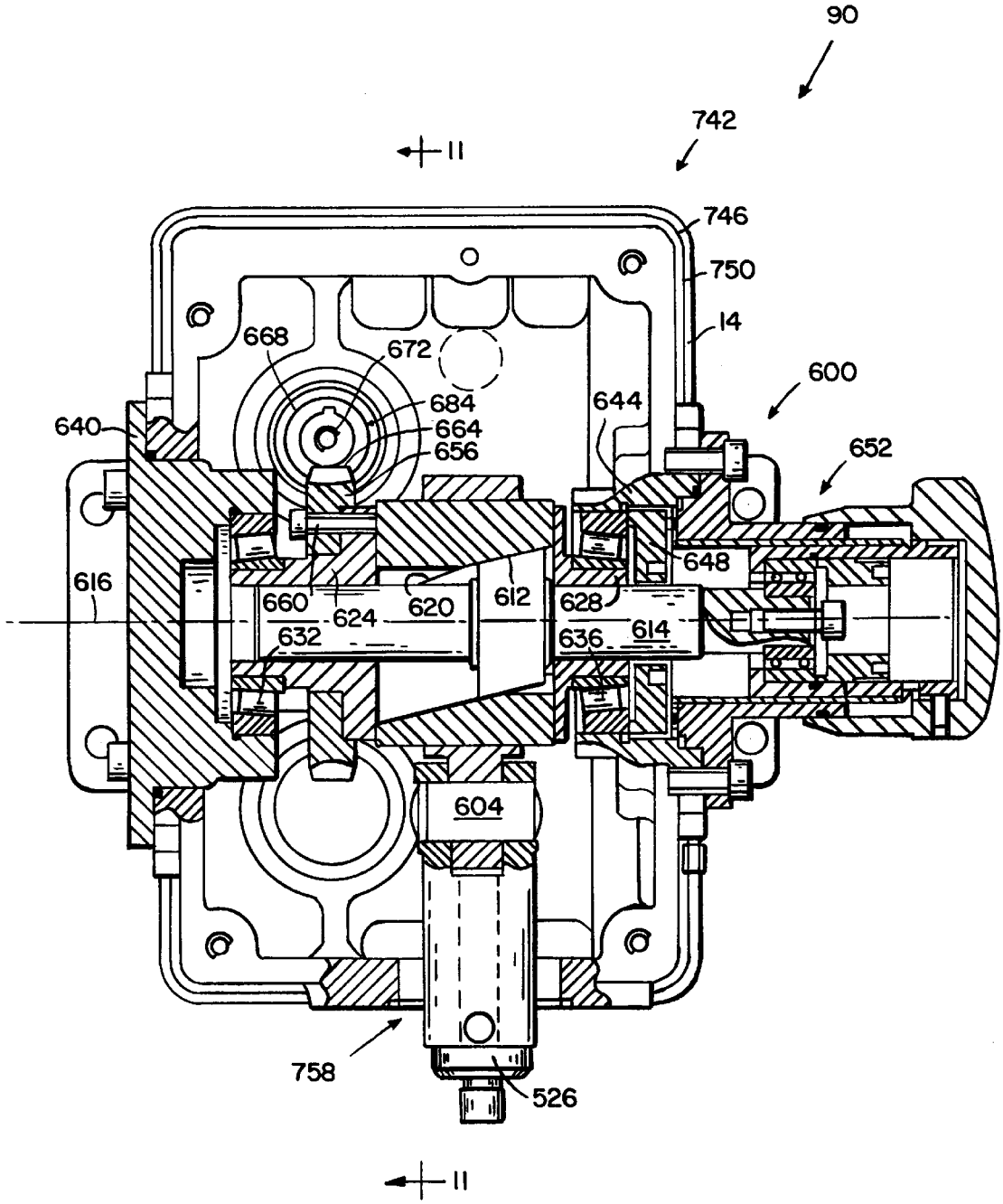
FIG. 10 is a partial sectional view taken generally along line 10—10 in FIG. 5.
Figure 11:
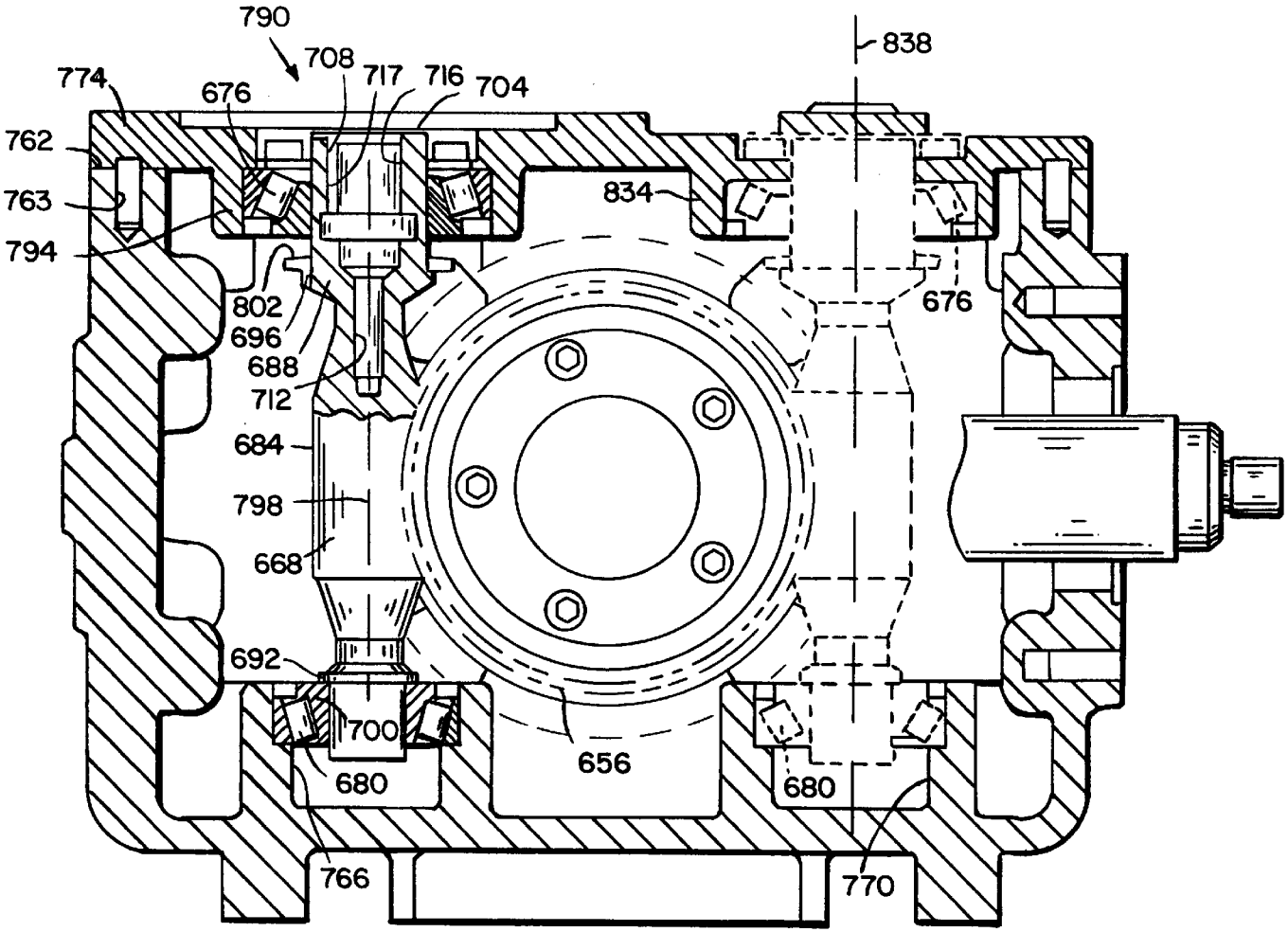
FIG. 11 is a partial sectional view taken generally along line 12—12 in FIG. 10.

The gear box 14 includes a housing 742 (best shown in FIGS. 6, 10 and 11). The housing 742 has a bottom portion 746 comprising spaced side walls 750 and a bottom 754. A forward one of the side walls 750 has therein an opening 758. The diaphragm adapter 63 (FIG. 1) is affixed to the forward side wall such that the cross head 526 extends through the opening 758. The side walls 750 cooperate to define (FIG. 11) a continuous upper edge 762 has therein a set of recesses 763 (FIG. 11). The bottom wall 754 includes spaced first and second bearing supports 766 and 770 for selectively and releasably supporting the roller bearing 680 in respective first and second positions.

Figure 5:
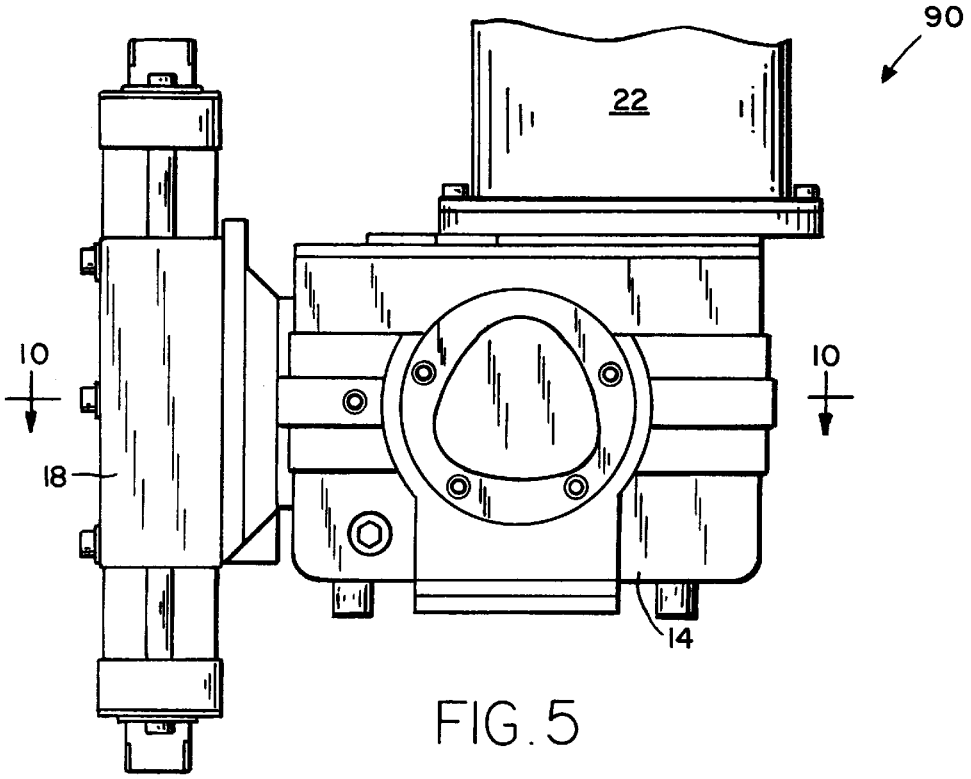
FIG. 5 is a partial slide view similar to FIG. 3, showing a pump arranged for direct connection of the motor to the worm gear.
Figure 3:
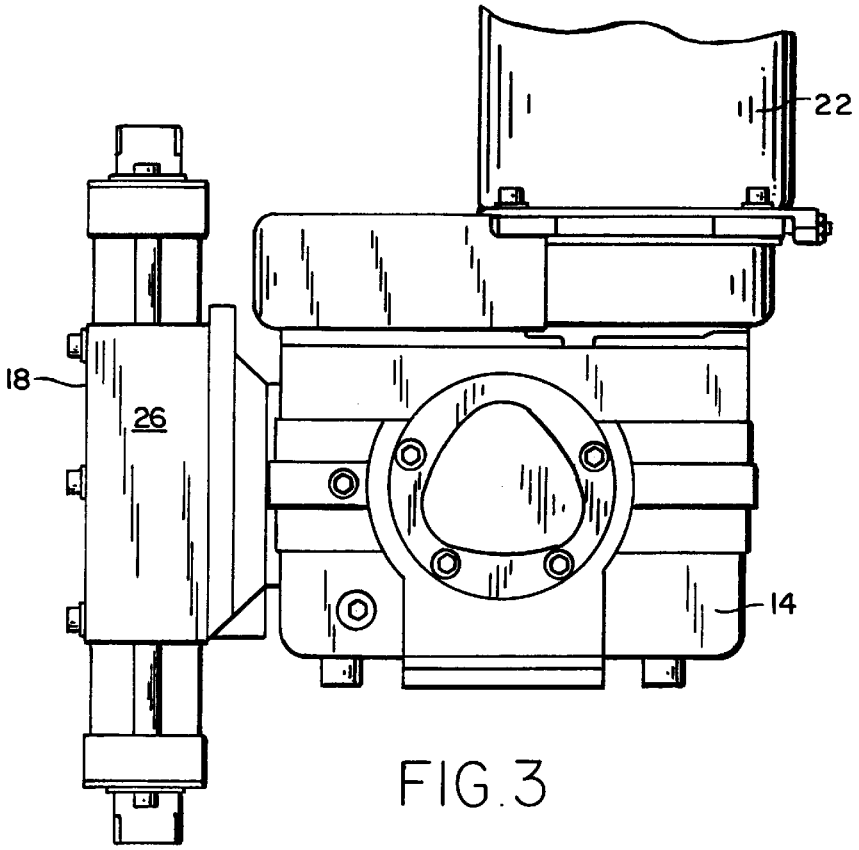
FIG. 3 is a partial side view taken generally along line 3—3 in FIG. 2.
Figure 7:
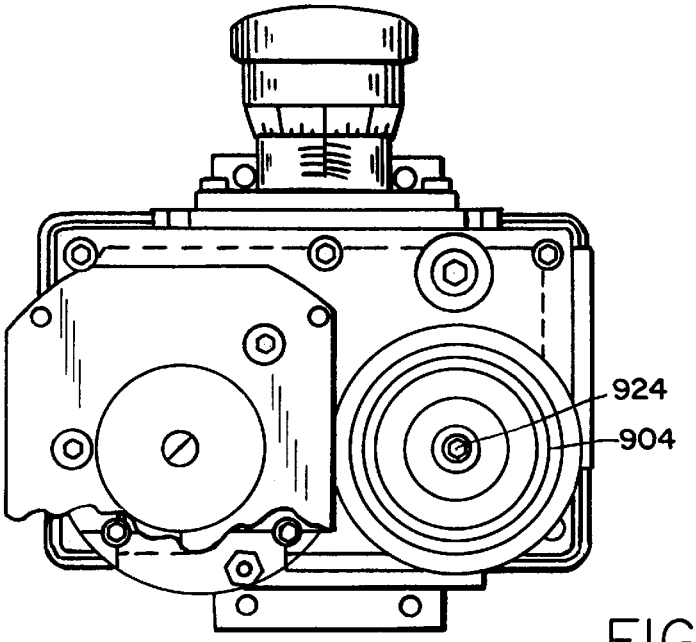
FIG. 7 is a sectional view taken generally along line 7—7 in FIG. 6 and with the motor and belt guard omitted.

The gear box housing 742 includes two interchangeable gear box covers which can be mounted on the bottom portion 746. A first or direct drive gear box cover 774 FIGS. 5, 9 and 11 is used for connecting the motor directly to the worm gear, and an alternative second or indirect drive gearbox cover 822 FIGS. 1–3 and 6 is used for connecting the motor indirectly to the worm gear. The direct drive gear box cover 774 (FIG. 5) includes a first set of bolt holes for receiving bolts which secure the direct drive gear box cover 774 to the bottom portion 746. The direct drive gear box cover 774 also includes a set of locator pins which are pressed into recesses 763 (FIG. 11) in the upper edge of the bottom portion 746. The direct drive gear box cover 774 also has therein a first shaft opening 790. The direct drive gear box cover 774 includes (FIG. 11) a first bearing support 794 for releasably supporting the roller bearing 676 in a first position. The cover first shaft opening 790, the cover first bearing support 794 and the bottom first bearing support 766 are aligned or centered on a common first axis 798. When the bearing 680 is supported by the bottom first bearing support 766 and the bearing 676 is supported by the cover first bearing support 794, the opposite ends of the worm shaft 668 are received in the respective bearings 676 and 680. The worm shaft 668 thus is supported in a first position in relation to the motor output shaft 718 and worm wheel 656. The worm shaft 668 and bearings 676 are prevented from movement in the direction along the first axis 798 by the shoulder 700 engaging the bearing 680, by the shoulder 696 engaging one side of a belleville washer 802, and by the opposite side of the belleville washer 802 engaging the bearing 676.

The direct drive gear box cover 774 also includes a set of threaded recesses for receiving bolts which also extend into the bolt holes in the direct drive motor mounting adapter to releasably secure the motor 22 in a first position (best shown in FIG. 5). When the motor 22 is in the first position, the motor output shaft 718 is directly drivingly connected to the worm shaft 668. When the motor 22 is mounted in the first position, the motor output shaft 716 extends through the cover first shaft opening 790 and is received in the unthreaded portion 716 of the worm gear recess 708. An elongated key 184 is received in the key way 717 in the worm gear recess 708 and in another key way in the motor output shaft 668 with the motor output shaft 716. The motor output shaft 716 is directly drivingly connected to the worm shaft 668.

The diaphragm pump 10 also includes means 818, best shown in FIG. 6, for indirectly drivingly connecting the motor 22 to the worm shaft 668. In the illustrated embodiment, the means 818 for indirectly connecting the motor 22 to the worm shaft 668 includes the second or indirect drive gear box cover 822 which replaces the direct drive gear box cover 774, the indirect drive motor mounting adapter 734, and a motor standoff plate 854.

The indirect drive gear box cover 822 includes a first set of bolt holes 826 which receive bolts for securing the indirect drive gear box cover 822 to the gear box bottom portion 746. The indirect drive gear box cover 822 also includes a shaft opening 831. The indirect drive gear box 822 includes a second bearing support 834 for releasably supporting the roller bearing 676 in a second position. The shaft opening 831, the second bearing support 834 and the bottom second bearing support 770 are aligned or centered on a common second axis 838. when the bearing 680 is supported by the bottom second bearing support 770 and the bearing 676 is supported by the cover second bearing support 834, the opposite ends of the worm shaft 668 are received in the respective bearings 676 and 680, and the worm gear axis 668 thus is supported in a second or indirect drive position in relation of the motor and worm wheel. The indirect drive gear box cover 822 also includes a set of threaded standoff recesses 840 spaced from the shaft opening 831.

The means 818 for indirectly drivingly connecting the motor 22 to the worm shaft 668 also includes a set of standoffs and a standoff plate for supporting the motor 22 in a second or indirect drive position. Each standoff is an elongated member which is threaded at the opposite ends thereof. One end is received in a standoff recess 840 in the indirect drive gear box cover 822. The opposite end is received in a recess 855 in the standoff plate 854. The standoff plate 854 also includes a set of bolt holes 857 through which bolts extend and are received in the elongated bolt holes 741 for securing the indirect motor mounting adapter 734 to the standoff plate 854.

The means 818 for indirectly drivingly connecting the motor 22 to the worm shaft 668 also includes (FIG. 6) a first set of pulleys 884 removably mounted on the motor output shaft 718. In the illustrated embodiment, the first set of pulleys 884 comprises four integral pulley steps of different diameters. The first set of pulleys 884 has therein a central bore 888. The central bore 888 includes a key way 892. The motor output shaft 718 is received in the central bore 888. An elongated key 896 is received in the key way 892 and in a key way 897 in the motor output shaft 718 to provide for common rotation of the first set of pulleys 884 with the motor output shaft 718.

The means 818 for indirectly connecting the motor 22 to the worm shaft 668 also it includes an input shaft 900 mounted in the worm gear recess 708 and a second set of pulleys 904 mounted on the input shaft 900. The input shaft 900 is an elongated member having a longitudinal axis 901 and a longitudinal bore 902. The input shaft 900 also includes a central portion 905 and inner and outer ends spaced in the longitudinal direction. The inner and outer ends are of reduced diameter in comparison to the central portion 905. The input shaft 900 extends (FIG. 6) through the shaft opening 831 in the second cover 822, and the inner end of the input shaft 900 is received in the unthreaded portion 716 of the worm gear recess 708. An elongated key 908 is received in the key way 717 in the worm gear recess 708 and in another key way in the input shaft 900 to provide for common rotation of the worm shaft 668 with the input shaft 900. In the illustrated embodiment, the second set of pulleys 904 comprises four integral pulley steps of different diameters. The second set of pulleys 904 has therein a central bore 912. The central bore 912 includes a key way 916. The input shaft 900 is received in the central bore 912. An elongated key 920 is received in the key way 916 in the central bore 912 and in another key way in the input shaft 900 to provide for common rotation of the second set of pulleys 904 with the input shaft 900. An elongated cap screw 924 extends through the longitudinal bore 902 in the input shaft 900. The cap screw 924 is received in the threaded portion 712 of the worm gear recess 708. A washer 928 is captured between the head of the cap screw 924 and the surface of the pulley to prevent axial movement of the input shaft 900 out of the worm gear recess 708. The input shaft 900 and the second set of pulleys 904 are thus mounted for common rotation with the worm shaft 668.

The means 818 for indirectly connecting the motor 22 to the worm shaft 668 also includes an endless flexible belt 932 (shown in phantom FIG. 6) which is trained about one of the first pulleys 884 and one of the second pulleys 904. The belt 932 thus indirectly and drivingly connects the motor output shaft 718 to the worm shaft 668. The belt 932 can be trained about either one of the first and second pulleys to adjust the speed at which the worm shaft 668 is driven in relation to the motor output shaft 718.

The diaphragm pump 10 also includes a belt guard 936 (FIG. 6) which covers the pulleys and belt. In the illustrated embodiment, the belt guard 936 comprises two housing portions and thus is removable from the pump.

The diaphragm pump 10 thus includes means for alternatively and selectively connecting the motor 22 directly and indirectly to the worm shaft 668. By connecting the motor 22 directly or indirectly to the worm shaft 668, the diaphragm 62 can be reciprocated at different selected speeds for pumping liquid at different rates.

The suction and discharge valves can be removed and replaced from the pump head without moving the pump and without disconnecting the suction and discharge pipes from the pump and without disassembly of the rigid piping connected to the pump. The suction and discharge valves are mounted on the truncated head externally to thus reduce the height of the pump head and the size of the pumping cavity.

Figure 15:
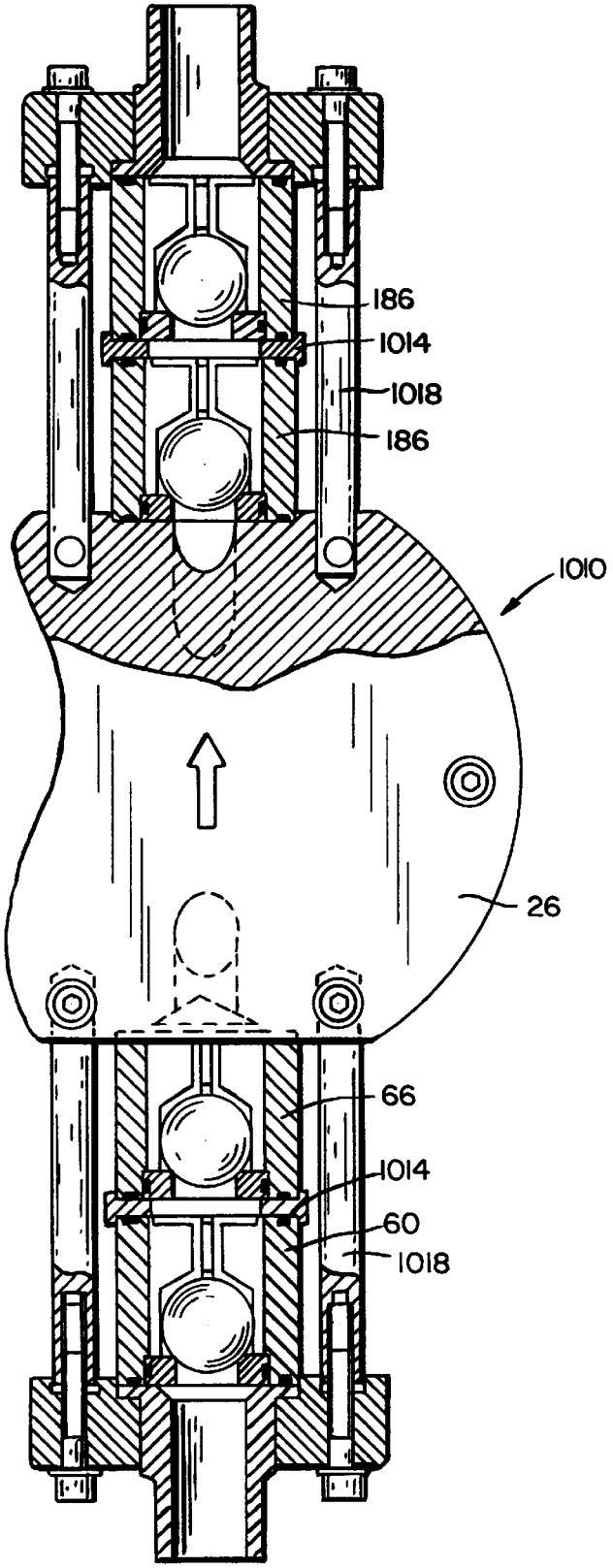
FIG. 15 is a view similar to FIG. 12 and showing a diaphragm pump which is an alternative embodiment of the invention.

A diaphragm pump 1010 which is an alternative embodiment of the invention is illustrated in FIG. 15. Except as otherwise described, the diaphragm pump 1010 is identical to the diaphragm pump 10 and identical reference numerals are used to identify similar components. The diaphragm pump 1010 includes a pair of suction valves 66 stacked on one another and separated by an annular spacer 1014. The diaphragm pump 1010 also includes a pair of discharge valves 186 stacked on one another and separated by an annular spacer 1014. The suction and discharge valves 66 and 186 are identical. In this embodiment the components of the valves can be the same components as used in the valves described above. In order to accommodate the stacked valves, the eye bolts 1018 which retain the suction and discharge valves on the pump head are longer than the eye bolts in the diaphragm pump 10. The provision of these double stacked valves illustrated in FIG. 15 provides for improved accuracy of the flow control through the pump.

What is claimed is:

1. A mechanically actuated diaphragm pump for pumping liquid comprising:

a pump head having a chamber;

a flexible diaphragm in the chamber and movable to cause pumping movement;

a reciprocally movable member for causing reciprocal movement of the flexible diaphragm, the reciprocally movable member being driven by an adjustably movable cam;

a motor drivingly connected to the adjustably moveable cam for causing reciprocation of the reciprocally moveable member; and means for drivingly connecting the motor to the reciprocally moveable member, the means for drivingly connecting the motor to the reciprocally moveable member including an Oldham coupling supported in the chamber by a taper roller bearing.

2. A mechanically actuated diaphragm pump as set forth in claim 1 wherein the Oldham coupling further includes a variable eccentric.

3. A mechanically actuated diaphragm pump a set forth in claim 1 and further including a worm shaft rotatably driven by the motor;

a worm gear driving by the worm shaft;

a driven shaft driven by the worm gear, the driven shaft having a longitudinal axis of rotation;

the adjustably movable cam surrounding the axis of the driven shaft and drivingly connected to the reciprocating member and being supported by eccentric movement with respect to the longitudinal axis of rotation.

4. A mechanically actuated diaphragm pump as set forth in claim 3 and further including means for adjusting the eccentricity of the cam with respect to the longitudinal axis of rotation.

* * * * *